6/9/87 XR 4,671,988

United States Patent [19]

Dowell et al.

[11] Patent Number: 4,671,988

[45] Date of Patent: Jun. 9, 1987

[54] CAMOUFLAGE KNITTED ARTICLE

[76] Inventors: James R. Dowell, No. 4, N. Yacht Club Bay, Tuscaloosa, Ala. 35406; Paul R. Laube, Bridgeport Rd., P.O. Box 488, West Union, S.C. 29696

[21] Appl. No.: 897,937

[22] Filed: Aug. 19, 1986

[51] Int. Cl.[4] ..... B32B 7/00; D04B 1/00

[52] U.S. Cl. ..... 428/226; 66/9 R; 66/190; 428/253; 428/919

[58] Field of Search ..... 428/919, 253, 225, 226; 6/9 R, 190

[56] References Cited

U.S. PATENT DOCUMENTS

| | | | |
|---|---|---|---|
| 3,507,130 | 4/1970 | Marks et al. | 66/169 |
| 3,621,677 | 11/1971 | Marks et al. | 66/9 R |
| 3,943,733 | 3/1976 | Wily | 66/125 R |

*Primary Examiner*—Marion C. McCamish
*Attorney, Agent, or Firm*—Cushman, Darby & Cushman

[57] ABSTRACT

A camouflage fabric having (1) opposed surface areas of a size sufficient to extend over the object or personnel to be camouflaged and (2) a weight per unit surface area within the range of 1 to 16 ounces per square yard. The camouflage fabric comprises a knit yarn fabric formed of a multiplicity of knit stitches and a multiplicity of parallel longitudinally extending inserts held in the knit fabric by longitudinally extending stitch sections of yarn between the inserts and transversely extending stitch sections of yarn on opposite sides of the inserts spaced longitudinally therealong. The strips are held by the knit yarn fabric so that opposite surface areas thereof correspond with opposite surface areas of the camouflage fabric and so that each side edge of each strip is disposed in spaced parallel relation with an opposite side edge of an adjacent strip. The spacing between each pair of adjacent side edges is greater then the size of the longitudinally extending stitches disposed therein so as to provide openings which allow for the flow of air through the camouflage fabric from either surface area thereof. The width of the strips is related to the spacing between each pair of adjacent side edges and the size of the knit fabric by which the strips are held such that the opposite surface areas of the strips define the visually dominant opposite surface areas of the camouflage fabric. A common one of the opposite surface areas of the strips has a predetermined camouflage pattern or patterns having continuity both in the direction of the strips and in a direction perpendicular thereto except for the spaces between strips so that the predetermined camouflage pattern or patterns can be presented as the visually dominant surface area of the camouflage fabric.

33 Claims, 3 Drawing Figures

CAMOUFLAGE KNITTED ARTICLE

This invention relates to the art of camouflaging objects and personnel and more particularly to improvements in a fabric for camouflaging objects and personnel.

The camouflaging herein contemplated includes both single individual camouflaging as well as wide area concealment camouflage situations. Conventional practice with respect to individual camouflaging material is to provide a woven material having an appropriate camouflage pattern printed on at least one surface thereof. The woven material is formed with a series of slits of C-shaped configuration, each slit defining a movable flap which provides for air flow through the material. Conventional wide area concealment material involves the utilization of a netting similar to the netting utilized in a tennis or badminton net and mechanically connecting to the netting on uniform centers (e.g. four inches to six inches) the slitted woven material, of the type previously indicated, in a draped or nontensioned conditioned. These conventional configurations constitute a compromise in achieving all of the desired characteristics of a camouflaging material which includes low weight, drapability, air movement therethrough, ability to conceal and, finally, cost effectiveness.

An object of the present invention is to provide a camouflage fabric which will achieve in larger measure the desirable characteristics of a camouflage material while correspondingly reducing the undesirable characteristics thereof. In accordance with the principles of the present invention, this objective is obtained by providing a camouflage fabric which has opposed surface areas of a size sufficient to extend over the object or personnel to be camouflaged and a weight per unit surface area within the range of two to sixteen ounces per square yard, preferably two to four ounces per square yard. The camouflage fabric comprises a knit yarn fabric formed of a multiplicity of knit stitches and a multiplicity of parellel longitudinal extending inserts held in the knit fabric by longitudinal extending stitch sections of yarn between the inserts and transversely extending stitch sections of yarn on opposite sides of the inserts spaced longitudinally therealong. Each of the inserts comprises a thin flexible opaque strip of a form and material composition capable of resisting disintegration by moisture absorption. Each of the strips has opposite surface areas defined between parallel side edges. In each strip the parallel side edges are spaced apart a distance substantially greater than the thickness thereof. The strips are held by the knit yarn fabric so that opposite surfaces thereof correspond with opposite surface areas of the camouflage fabric and so that each side edge of each strip is disposed in spaced parallel relation with an opposite side edge of an adjacent strip. The spacing between each pair of adjacent side edges is greater than the size of the longitudinally extending stitches disposed therein so as to provide openings which allow for the flow of air through the camouflage fabric from either surface area thereof. The width of the strips are related to the spacing between each pair of adjacent side edges and the size of the knit fabric with which the strips are held such that the opposite surface areas of the strips define the visually dominant opposite surface areas of the camouflage fabric. A common one of the opposite surface areas of the strips have a predetermined camouflage pattern or patterns thereon. The predetermined camouflage pattern or patterns have continuity both in the direction of the strips and the direction perpendicular thereto except for the spaces between strips so that the predetermined camouflage pattern or patterns can be presented as the visually dominate surface area of the camouflage fabric.

Another object of the present invention is the provision of a camouflage fabric which is simple in construction, effective in operation and economical to manufacture.

These and other objects of the present invention will become more apparent during the course of the following detailed description and appended claims.

The invention may best be understood with reference to the accompanying drawings wherein an illustrative embodiment is shown.

IN THE DRAWINGS

Figure 1:
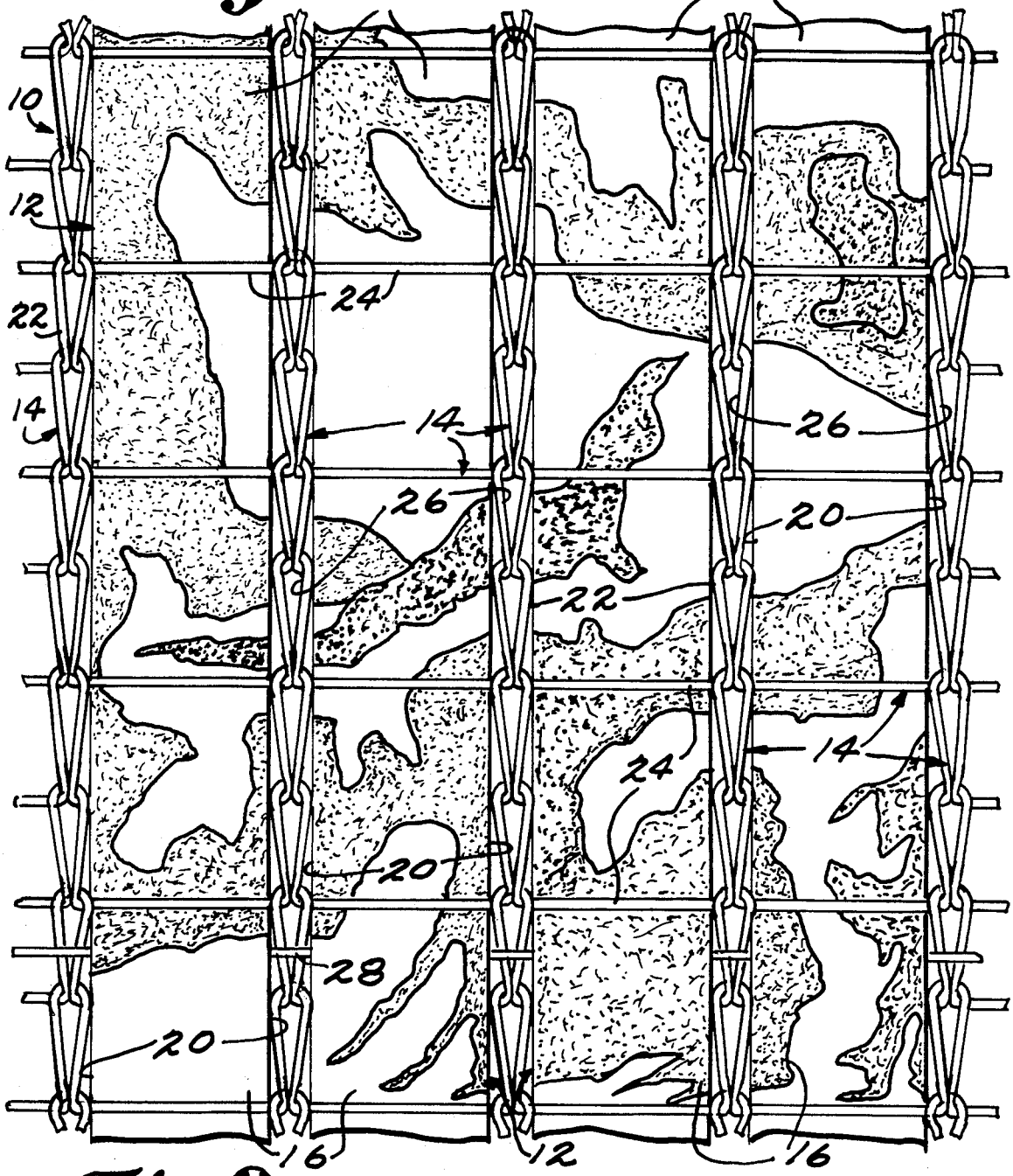
FIG. 1 is a fragmentary top plan view of one embodiment of a camouflage fabric constructed in accordance with the principles of the present invention.
Figure 2:
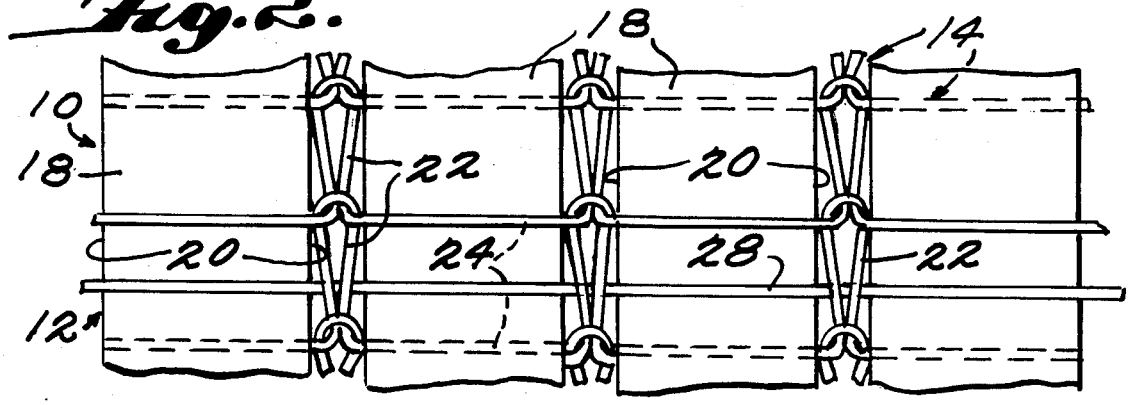
FIG. 2 is a fragmentary bottom plan view of the fabric shown in FIG. 1.

Referring now more particularly to the drawings, there is shown in FIGS. 1 and 2 thereof a portion of an article for camouflaging objects and personnel, generally indicated at 10, which embodies the principles of the present invention. The article 10 constitutes in essence a camouflage fabric, the area size of which is dependent upon the extent of the object and/or personnel which is to be camouflaged thereby. It will be understood that the article may be of a size to camouflage a single individual military person or may extend to a wide area concealment situation, such as multiple personnel and/or large equipment, such as gun installations etc.

The camouflage article 10 is produced upon a conventional knitting machine of the type having the capability of incorporating parallel inserts within the knitted fabric as the knitting proceeds. Consequently, where the article is of relatively small area size, the article may be simply a section of the fabric produced on the knitting machine. On the other hand, where wide area concealment is desired the article may consist of a number of sections from a conventional knitting machine of the type noted above suitably secured together.

The conventional knitting machine having the aforesaid capability rendering it suitable to be utilized for producing the camouflage article 10 of the present invention may be either of the weft knit type or of the warp knit type. Examples of a circular knitting machine of the weft knit type which may be utilized in accordance with the principles of the present invention are disclosed in U.S. Pat. Nos. 3,507,130, 3,621,677, and 3,943,733. Any of the more common warp knit machines may be utilized, such as Raschel, Tricot, paraelle weft insertion known as weft insertion warp knit machines. These are manufactured by companies as Mayer Textile Machines, Obertshausen, West Germany, Liba Textile Machines, Naila, West Germany, Cidga Machines, New Jersey, U.S.A. or manufactured on the malimo warp technique on a malimo type machine as is manufacturered by VEB Nahwirk Maschine Textima, Karl Marx Stadt, East Germany.

Also, in accordance with the principles of the present invention, it is important that the parallel inserts have printed thereon a camouflage pattern, the continuity of which is substantially maintained when the inserts are incorporated within the knitted fabric by the operation of the machine. Preferably, this function is achieved by printing the predetermined camouflage pattern on the surface of a sheet and then slitting the sheet continuously and utilizing the slits formed by the slitting operation as the inserts which are fed to the continuous knitting machine. By carefully controlling the feed of the strips, the sheet pattern as it appears in the camouflage fabric has continuity both in the direction of the strips and in a direction perpendicular thereto except for the spaces between the strips. Alternatively, printing of the camouflage pattern may be accomplished after the slitting operation or may be accomplished by printing on a series of side-by-side tapes. The camouflage pattern may be in accordance with known practices and its specific characteristics will be dictated by the particular use contemplated.

The article 10, shown in FIGS. 1 and 2, constitute a camouflage fabric which has been produced on the weft knitting machine, such as disclosed in U.S. Pat. Nos. 3,507,130 and 3,621,677, utilizing a conventional camouflage fabric as the fabric sheet which is slit and fed to the machine as warp inserts. In FIG. 1 the inserts are designated generally by 12 and the weft knit fabric which is knitted on the machine is designated generally by 14. The inserts can be made of animal, plant or manmade materials so long as they are resistant to deterioration by moisture absorption. The material can be chemically treated for this purpose. The materials used can be non-woven, warp or weft knitted or formed sheeting. A preferred conventional camouflage fabric that is used to form the inserts 12 is a woven material in which the warp and weft yarns are formed of a continuous multifilament manmade fiber, for example, polyester, which has a size of 177 denier. The woven fabric has approximately 96 warp ends per inch across the width and 55 picks per inch in the longitudinal direction. The denier range can vary from 10 denier to 5000 denier depending upon the density of the insert material. The woven fabric has a camouflage pattern, indicated at 16 in the drawings, formed on one surface thereof. The opposite surface of the fabric has a metalized coatinq 18 applied thereto (see FIG. 2) (e.g. aluminized) which provides a deception to scramble the passage of radar, infrared and other invisible waves.

The yarn used to form the weft knit fabric may be animal, plant or manmade in so far as material is concerned so long as it is resistant to disintegration by moisture absorption. It may be chemically treated continuous, multifilament, monofilament or spun. The preferred yarn used to form the weft knit fabric 14 is made of manmade material, for example, polyester, having a 330 denier and plyed into 2 ends.

The yarn used in predetermined spaced courses (e.g. every 60th course) may be formed of conventional hot melt yarn (e.g. a PCL coating) which after fabrication is heated to an operating temperature of approximately 180° which has the effect of thermal bonding the stitches formed thereby. This thermal bonding of the stitches controls running.

The camouflage sheet as described above from which the inserts 12 are made comes in large rolls and the sheet form of the fabric is continuously slit as it comes from the roll so as to provide inserts 12 having parallel side edges 20. Preferably, the side edges 20 of all the strips are spaced apart equal distances and, in the embodiment shown in FIGS. 1 and 2, a width dimension of approximately 1 and 3/32 of an inch is utilized. In the operation of the knitting machine, the yarn that is to be knitted by the operation of the machine is formed into a fabric consisting of a multiplicity of knit stitches. As shown, the inserts 12 are held in the knit fabric 14 by longitudinally extending stitch sections of yarn 22 which extend between the side edges 20 of adjacent inserts 12 and transversely extending stitch sections of yarn 24 which are disposed on opposite sides of the inserts 12 and spaced longitudinally therealong. The strips 12 are relatively thin and their width is substantially greater than the thickness.

It is important to note that the strips are held by the knit yarn fabric so that opposite surface areas thereof correspond with opposite surface areas of the camouflage fabric and so that each side edge of each strip is disposed in spaced parallel relation with an opposite side edge of an adjacent strip (e.g. 5/32"). The spacing between each pair of side edges is greater than the size of the longitudinally extending stitches disposed therein so as to provide openings 26 which allow for the flow of air through the camouflage fabric from either surface thereof. The width of the strips is related to the openings 26 provided by spacing between each pair of adjacent side edges and the size of the knit fabric by which the strips are held such that the opposite surface areas of the strips define the visually dominant opposite surface areas of the camouflage fabric. By providing a preprinted sheet of camouflage fabric which is slit and control fed to the knitting machine, it is insured that the strips having the camouflage pattern 16 printed thereon will appear in a common one of the surface areas of the strips. Moreover, the pattern 16 has continuity both in the direction of the strips and in a direction perpendicular thereto except for the spaces between strips so that the predetermined camouflage pattern or patterns can be presented as the visually dominant surface area of the camouflage fabric.

The resultant camouflage fabric including both the knit fabric 14 and inserts 12 has a weight of approximately 3.5 ounces per square yard. Weight is controlled by the size of the knit yarn, by the stitch size of the knit fabric, the input material for the inserts, and finally the wales and courses per inch of the stitches.

It will be understood that it is within the contemplation of the present invention to vary the characteristics which are specifically exemplified in the camouflage fabric shown in FIGS. 1 and 2. For example, the fabric could be made on a weft knitting machine using weft inserts in accordance with the teachings of U.S. Pat. No. 3,943,733, although the warp inserting operation is preferred because the resultant camouflage fabric can be manufactured so as to be of extensive length for storage and transportation in rolled up form.

In addition to the above characteristics of the inserts 12 and knitted fabric 14, it is important that both be formed of a material composition capable of resisting disintegration by moisture absorption. Insofar as the yarn for the knitted fabric 14 is concerned the yarn may be from 20 denier to 10,000 denier and be one end or multiple ends. The inserts may be woven, non-woven, warp or weft knitted material, they may be mechanically or chemically finished, may be plastic sheeting and may be chemically or physically treated including both the camouflage patterns on one side and the provision of a metalized coating (e.g. aluminized) on the other.

Another desirable functional characteristic provided by the present camouflage article 10 is a high degree of drapability. This is obtained through the combination of the knitted fabric and the plurality of individual insert strips which resists the crimping and creasing which is often evident in nonwoven, spun bonded, plastic or foil materials. Another desirable characteristic is that the article 10 allows an optimum amount of air movement in a manner which does not materially diminish the stability of the fabric. Air movement is achieved by the openings 26. The denier of the yarn used to form the yarn fabric stitches and the number of wales and courses per inch can be varied to vary the amount of air passage.

Since the camouflage pattern printed on the strips 12 constitute the dominant visual effect of the article 10, this feature together with the drapability provide a highly desirable concealment factor. Due to the light weight and flexibility, the article 10 can be provided in rolls offering coverage to persons and objects as needed rather than transporting large bundles of materials at heavy weights to individual and objects which may not be used.

With respect to certain of the variables of the article 10, the weight may vary within the range of one to sixteen ounces per square yard although a preferred range is two to four ounces per square yard. The width of the inserts 12 may vary within an operative range of 0.10 to 1 inches with a preferred range being 0.16 to 0.5 inches. The courses per inch can vary between two to thirty courses with a preferred range being four to six courses. The wales per inch may vary between 0.143 to 16 wales per inch with a preferred range within 1 to 6.5 wales per inch. A preferred width of the material is 4.6 feet although conventional widths may be 2.3 to 10 feet.

Where the article 10 is to be used in a wide area concealment situation, it will be understood that two or more widths may be secured together by any known securing means, such as stitching, lashing, fasteners, adhesive, etc. A preferred mode of securement which is added during fabrication and renders the article 10 suitable for use alone or in plural arrangements is shown in FIGS. 1 and 2. As shown, during the fabrication of the article 10 on a weft knitting machine, as indicated above, an elongated flexible tying element 28 is inserted in the fabric as a weft insert so that the element is held in the weft knit fabric 14 on the side of the inserts 12 opposite from the camouflage pattern. The number of tying elements inserted can vary as desired, a preferred example being every 16 courses. The flexible element may be yarn, rope, twine, cord, string, braided strand, strips of any suitable material or the like, a preferred example being nylon plied yarn. After the article is formed on a circular weft knitting machine the tube is slit longitudinally along a selvage area. The selvage area may be heat shrunk to enable a greater amount of the ends of the flexible element 28 to extend beyond the adjacent sides of the fabric.

Figure 3:
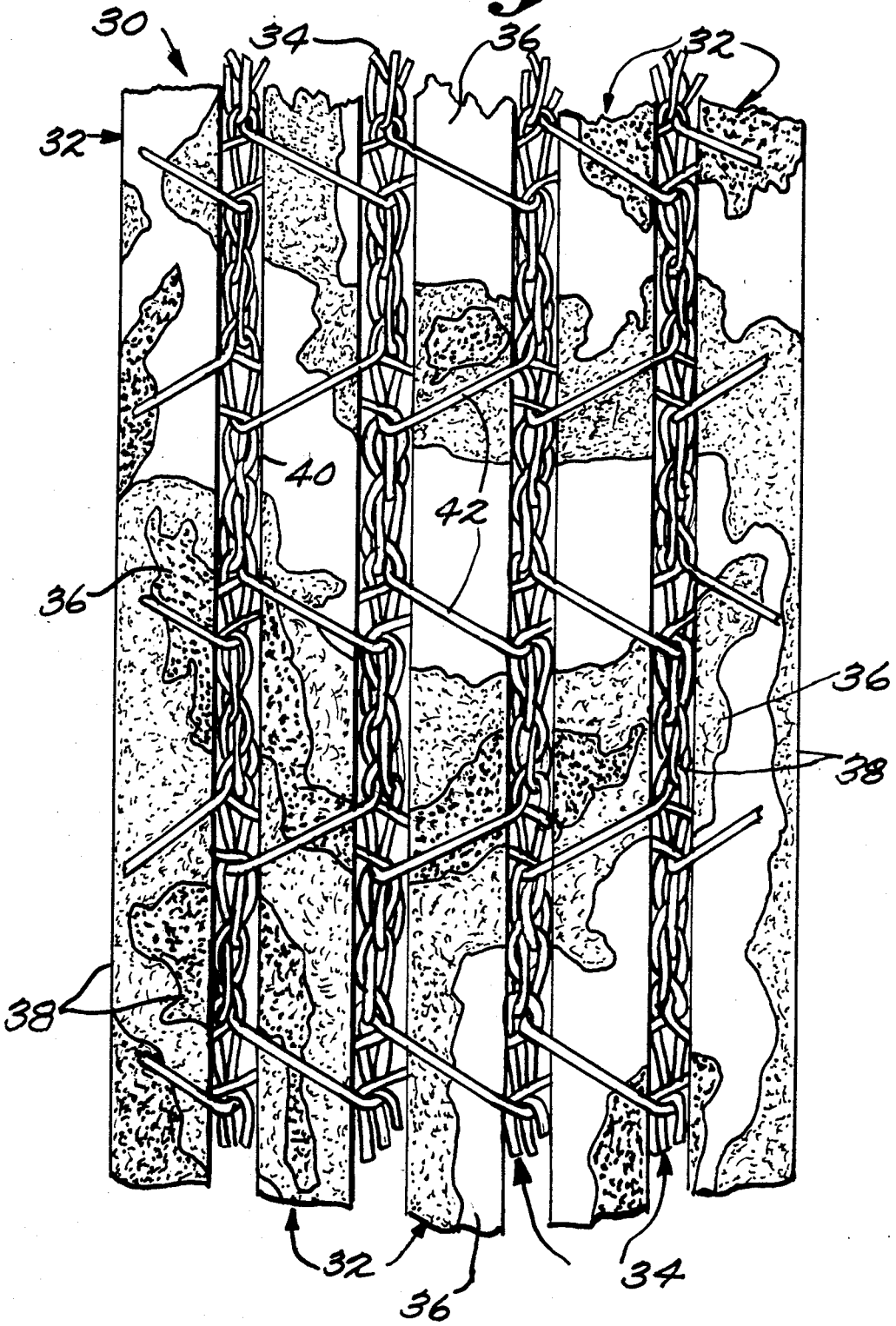
FIG. 3 is a view similar to FIG. 1 of another embodiment of a camouflage fabric constructed in accordance with the principles of the present invention.

FIG. 3 illustrates another embodiment of a camouflaging article, generally indicated at 30 which is made on a Raschel warp knit knitting machine with insert capability in the warp direction. It will be noted that the article 10 includes a multiplicity of parallel inserts 32 retained in position by a knit yarn fabric 34. As before, the inserts 32 are formed with a camouflage pattern 36 on one surface thereof. As before, a sheet with the camouflage pattern or patterns printed thereon is slit to provide parallel side edges 38. As before, the knit yarn fabric 34 includes longitudinal stitches 40 which are disposed in spaces between adjacent side edges 38 of the inserts 32 and transversely extending stitch sections 42 which extend on opposite sides of the inserts 32 in longitudinal spaced relation therealong. The sheet material with the printed camouflage pattern printed thereon may be the same material as in article 10. However, in the article 30 the width of the strips slit from the sheet is approximately $\frac{3}{8}$ of an inch. The spacing between the side edges of adjacent strips is also approximately 5/32 of an inch. The knitted fabric is made on a machine with two guide bars and three needles per inch. The working width of the machine is 120 width in the wale direction. The courses per inch in the weft direction are six courses per inch.

It will be understood, however, that the machine utilized may include two to eight guide bars with two to four guide bars being preferred. The machine may have one needle every seven inches up to sixteen needles per inch and preferably is within a range of two needles per inch to four needles per inch. The operative working width of the machine can extend from 24 inches to 280 inches in the wale direction with a preferred width being in the range of 60 inches to 180 inches. The courses per inch in the weft direction can vary within a range of two to fifty courses per inch with a preferred range being four to eight courses per inch. The warp insert width may vary between a range of 0.0625 to 7 inches with a preferred range being 0.09 to 2 inches.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. An article for camouflaging objects and personnel comprising a camouflage fabric having (1) opposed surface areas of a size sufficient to extend over the object or personnel to be camouflaged and (2) a weight per unit surface area within the range of 1 to 16 ounces per square yard, said camouflage fabric comprising a knit yarn fabric formed of a multiplicity of knit stitches and a multiplicity of parallel longitudinally extending inserts held in said knit fabric by longitudinally extending stitch sections of yarn between said inserts and transversely extending stitch sections of yarn on opposite sides of said inserts spaced longitudinally therealong, each of said inserts comprising a thin flexible opaque strip of a form and material composition capable of resisting disintegration by moisture absorption, each of said strips having opposite surface areas defined between parallel side edges said parallel side edges of each strip being spaced apart a distance substantially greater than the thickness of the strip, said strips being held by said knit yarn fabric so that opposite surface areas thereof correspond with opposite surface areas of the camouflage fabric and so that each side edge of each strip is disposed in spaced parallel relation with an opposite side edge of an adjacent strip, the spacing between each pair of adjacent side edges being greater then the size of the longitudinally extending stitches disposed therein so as to provide openings which allow for the flow of air through the camouflage fabric from either surface area thereof, the width of the strips being related to the spacing between each pair of adjacent side edges and the size of the knit fabric by which the strips are held such that the opposite surface areas of the strips define the visually dominant opposite surface areas of the camouflage fabric, a common one of the opposite surface areas of said strips having predetermined camouflage pattern means thereon, said predetermined camouflage pattern means having continuity both in the direction of the strips and in a direction perpendicular thereto except for the spaces between strips so that said predetermined camouflage pattern means can be presented as the visually dominant surface area of the camouflage fabric.

2. An article as defined in claim 1 wherein said strips are slit from a sheet having said camouflage pattern printed on one surface thereof.

3. An article as defined in claim 2 wherein said sheet is and has its opposite side provided with a metalized coating capable of providing a deception to scramble radar, infrared and other similar invisible waves.

4. An article as defined in claim 3 wherein the weight of said camouflage fabric is within the range of 2 to 4 ounces per square yard.

5. An article as defined in claim 4 wherein said inserts are warp inserts.

6. An article as defined in claim 5 wherein said knit yarn fabric is a weft knit yarn fabric.

7. An article as defined in claim 6 wherein said weft knit yarn fabric has a number of courses per inch within a range of 3 to 30.

8. An article as defined in claim 7 wherein said courses per inch range is 4 to 6.

9. An article as defined in claim 8 wherein said weft knit yarn fabric has a number of wales per inch in the range of 0.143 to 16.

10. An article as defined in claim 9 wherein said wales per inch range is 1 to 6.5.

11. An article as defined in claim 10 wherein said strips have a width within a range of 0.1 to 1 inches.

12. An article as defined in claim 11 wherein the width range is 0.16 to 0.5 inches.

13. An article as defined in claim 12 wherein said knit yarn fabric is knitted from polyester yarn.

14. An article as defined in claim 5 wherein said knit yarn fabric is a warp knit yarn fabric.

15. An article as defined in claim 14 wherein said warp knit yarn fabric has a number of courses per inch in the weft direction in the range of 2 to 50.

16. An article as defined in claim 15 wherein said course range is 4 to 8.

17. An article as defined in claim 16 wherein the width of said inserts are within a range of from 0.0625 to 7 inches.

18. An article as defined in claim 17 wherein said width range is 0.09 to 2 inches.

19. An article as defined in claim 1 wherein the weight of said camouflage fabric is within the range of 2 to 4 ounces per square yard.

20. An article as defined in claim 1 wherein said inserts are warp inserts.

21. An article as defined in claim 1 wherein said knit yarn fabric is a weft knit yarn fabric.

22. An article as defined in claim 21 wherein said weft knit yarn fabric has a number of courses per inch within a range of 3 to 30.

23. An article as defined in claim 22 wherein said courses per inch range is 4 to 6.

24. An article as defined in claim 21 wherein said weft knit yarn fabric has a number of wales per inch in the range of 0.143 to 16.

25. An article as defined in claim 24 wherein said wales per inch range is 1 to 6.5.

26. An article as defined in claim 21 wherein the width range is 0.16 to 0.5 inches.

27. An article as defined in claim 21 wherein certain of the stitch sections of yarn of said knit fabric are thermal bonded to control running.

28. An article as defined in claim 21 wherein longitudinally spaced elongated flexible tying elements are held in the knit fabric as transversely extending inserts extending from opposite sides of the knit fabric.

29. An article as defined in claim 1 wherein said knit yarn fabric is knitted from polyester yarn.

30. An article as defined in claim 1 wherein said knit yarn fabric is a warp knit yarn fabric.

31. An article as defined in claim 30 wherein said warp knit yarn fabric has a number of courses per inch in the weft direction in the range of 2 to 50.

32. An article as defined in claim 31 wherein said course range is 4 to 8.

33. An article as defined in claim 32 wherein the width of said inserts are within a range of from 0.09 to 2 inches.

* * * * *